United States Patent [19]

McLaughlin et al.

[11] Patent Number: 4,532,791

[45] Date of Patent: Aug. 6, 1985

[54] ARRANGEMENT AND OPERATION THEREOF FOR THREADING A ROTATABLE ASSEMBLY

[75] Inventors: James L. McLaughlin; Donald J. Custer, both of Akron; Richard J. Donze, Stow, all of Ohio

[73] Assignee: Morgan Construction Company, Worcester, Mass.

[21] Appl. No.: 545,711

[22] Filed: Oct. 26, 1983

[51] Int. Cl.[3] ..... B21C 1/14

[52] U.S. Cl. ..... 72/275; 72/289; 226/91; 242/82

[58] Field of Search ..... 72/275, 289; 242/82, 242/83; 226/91, 92

[56] References Cited

U.S. PATENT DOCUMENTS

| | | | |
|---|---|---|---|
| 3,780,963 | 12/1973 | Hirschfelder | 242/82 |
| 3,833,161 | 9/1974 | Krumbein | 226/92 |
| 3,881,340 | 5/1975 | Hay et al. . | |
| 4,149,398 | 4/1979 | Eichenlaub, Jr. . | |

FOREIGN PATENT DOCUMENTS

| | | | |
|---|---|---|---|
| 11941 | 12/1902 | Norway | 226/92 |
| 2,038,219 | 7/1980 | United Kingdom . | |
| 2078583 | 1/1982 | United Kingdom | 72/289 |

*Primary Examiner*—Daniel C. Crane

*Attorney, Agent, or Firm*—Maurice E. Gauthier

[57] ABSTRACT

An arrangement for and method of operation for threading strand-like material such as wire or tubing around a grooved type, rotatable block assembly wherein tension is needed to pull the material through a reduction die, includes a plate mounted on the same shaft as the block. This plate supports three devices used in a time sequence relationship in said threading operation for the drawing process: a gripper arm for grasping the pointed end and introducing it into the groove; a shear for severing the pointed end; and a deflector mechanism for guiding the material away from the block assembly. Clutch assemblies are selectively operated to place the plate into and out of engagement with the drawing block for the plate's rotation therewith and it's non-rotation.

21 Claims, 7 Drawing Figures

ARRANGEMENT AND OPERATION THEREOF FOR THREADING A ROTATABLE ASSEMBLY

BACKGROUND OF THE INVENTION

The present invention relates to an arrangement and method for threading elongated material around a rotatable assembly. More particularly, an improved design is provided for an automatic threading process in mounting a gripper arm, a shear, and a material guiding device adjacent to a rotatable drawing block assembly used in pulling wire or tubing through a reducing die, whereby the drawing block does not stop rotating even after the material is placed around the block.

Presently, it is the practice for the cold drawing of metallic strand material, such as wire or tubing, to create the required tension on the material by passing a portion of a single convolution or a greater predetermined length of material around a rotatable block arranged downstream from a die assembly.

At the start of an existing drawing operation, the strand-like material is introduced onto the block into a groove around the block's periphery by providing a gripper which generally is mounted on the block and positionable in line with a reducing die to receive the material as it leaves the die. The gripper grasps the pointed end of the material, and the block with the gripper is rotated approximately 310 degrees at which time rotation is stopped, and the tapered or pointed end is sheared by an externally mounted shearing device which is brought near the block assembly for the shearing operation.

From a design standpoint, there are several disadvantages inherent in this arrangement, i.e. where the gripper arrangement is mounted on the block. The drawing block assembly normally rotates at extremely high speeds thereby increasing (a) the inertia of the system; (b) the braking force necessary for stopping the block; (c) the need for static or dynamic balancing of the components; and (d) the chances of the gripper arrangement being thrown off the rotating block.

From an operational standpoint, a further disadvantage of the aforesaid design where the gripper is mounted on the block assembly and an external shear cuts the tapered end, is that the rotation of the block must be stopped in order to effect the cutting of the tapered end. It is then necessary to remove the gripper from the block or to swing it out of the way of the travelling material, and the shear is moved out of the way of the rotating block. This procedure decreases the production cycle time in the reduction process.

Since the pointed end is sheared in the "threading" or "stringing" up step of the drawing process in the above prior block design, as stated above, the block's rotation is stopped and then started up again for the remaining drawing process. This stopping and starting of the block's rotation in most instances can result in the breakage of the material being drawn.

Another design for a block assembly has evolved where the gripper is detachable from the block, and therefore remains in a stationary position relative to the rotation of the block assembly. The gripper is mounted to an arm, which, in turn is mounted to a bushing on a drive shaft of the block. This arrangement is shown in U.K. Patent Application No. 2,078,583. The arm is freely rotatable and displaceable about the axis of the drawing block and is also selectively drivable by the block through a manually insertable pin for the "threading up" or initial stage of the drawing process. This design eliminates most of the disadvantages associated with the aforesaid arrangement where the gripper is mounted directly onto the block; however, it presents other serious problems in that for the shearing of the pointed end, it is necessary to stop the block so that the shear, which as mentioned is external to the block and gripper, can be brought into position to cut the pointed end. Thus, it is necessary to start the motor to rotate the block, stop it when the material is placed substantially around the block, then start the motor again for the remaining drawing process.

This '583 design may require precise timing and fine tolerances of the mating parts in order for the insertable driving pin to engage the gripper arm and/or block for it to be driven by the main motor of the block's drive system.

A serious disadvantage common to the two above designs in the prior art is in locating the shear relative to the material in a manner that the exact length of pointed end is cut-off with little or no material wastage, i.e. several extraneous devices are positioned around the drum's periphery, making it somewhat difficult to position the shear close enough to sever the desired length of pointed end, which in most instances, is nine (9) inches from the tapered point inwardly along the material. Also, the "threading-up" of both designs require in their most efficient form, considerable manual assistance and utmost loss of production.

SUMMARY OF THE INVENTION

It is, therefore, an object of the present invention to provide for an automatic "threading phase" for stranded material, such as wire or tubing, in a drawing production line for example, an arrangement and its method of operation which is separated from the rotatable block for supporting at least a gripper for introducing the material onto the block. and which arrangement consists of means and method for automatically engaging and disengaging said arrangement with the rotatable block for its rotation and non-rotation, respectively, therewith.

A further object of the present invention is to provide in such an arrangement and method, which, in addition to a gripper, supports a shearing device to automatically sever a desired length of the tapered end of the strand of material and which provides for the continuous rotation of the block from start up to finish of the reducing process.

More particularly, it is an object of the present invention to provide in such an automatic system a disc or plate means for supporting a gripper, a shear, and a material deflector means, which plate means is located adjacent to and mounted on the same shaft as the rotatable drawing block, and consists of high pressure clutches automatically engageable with the drawing block for the "threading up" phase for a rotation of less than 360 degrees, and then automatically disengageable so that the block assembly continues to rotate without stopping for the remaining phase of the operation.

And yet a further object of the present invention is to provide one or more discreet clutches on said plate means for engagement with said block assembly for the reverse rotation back to the threading position.

According to the present invention, there is provided an arrangement for automatically placing a length of filament material around a generally cylindrical surface of a rotatable member so that said material can be advanced to said rotatable member from a position upstream thereof, comprising drive means for rotating said rotatable member, rotatable plate means constructed and arranged in a manner to be in close proximity and co-axial to said rotatable member, gripper means carried by said plate means constructed and arranged in a manner to selectively grasp and release a leading end of said material positioned for gripping by said gripper means, the relationship of said rotatable member, said plate means, and said gripper means being such that said gripper means on moving from a start position will place said material on said cylindrical surface, and power transmitting means mounted to either said plate means or said rotatable member for selectively causing said plate means to be in engagement or out of engagement with said rotatable member, and constructed in a manner that upon said engagement, said plate means rotates with said rotatable member as a unit in the same direction, said power transmitting means including means for automatically effecting said disengagement of said plate means from said rotatable member upon a predetermined rotation of said rotatable member without interrupting said rotation of said rotatable member.

And further, according to the present invention there is provided a method for automatically handling film-like material during a threading procedure in which the material is to be placed at least partially around the periphery of a rotatable member, such as a wire drawing block, and wherein a carrying means is arranged to rotate concentric with and in the same direction of the block and adapted to carry a gripping means, the steps comprising with said gripper means in a start phase, causing the gripper means to grip the leading end of the material, at approximately the same time as said gripping step, initiating the rotation of said block and at approximately the same time connecting in a driving relationship said carrying means to said block to cause said carrying means to displace said gripper means and cause the material to be at least partially tightly wound around the block, before said block and carrier means have rotated a predetermined amount, bringing the gripper means to a release and stop phase and degripping the material and at approximately the same time causing a deceleration of the carrying means while continuing to rotate said block.

These and other objects of the subject invention will be better appreciated and understood when the following description is read along with the accompanying drawings.

DESCRIPTION OF A PREFERRED EMBODIMENT

Figure 1:
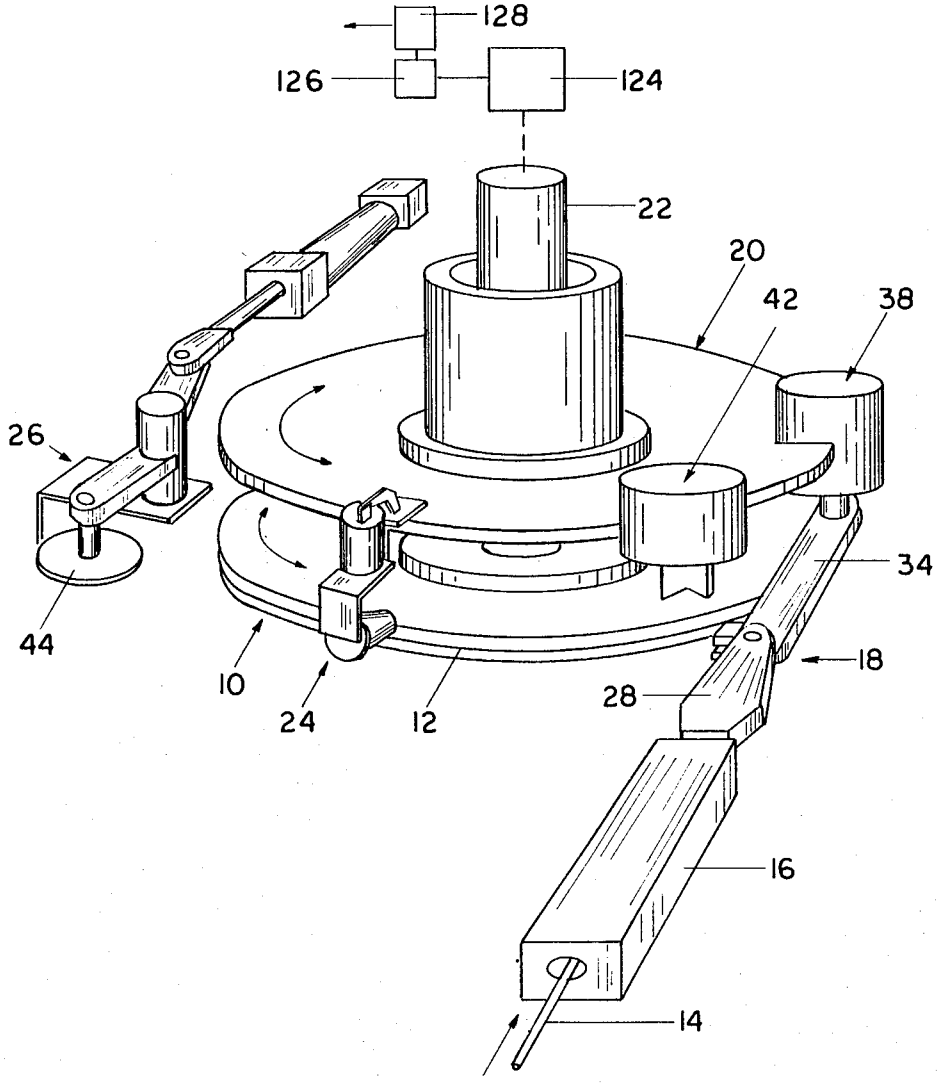
FIG. 1 is a schematic, isometric view incorporating the subject invention in equipment used in a drawing production line.

The subject invention as shown in FIG. 1 will be discussed in conjunction with a drawing block 10 having a single, endless groove 12 for receiving copper tubing 14, which after it leaves the block 10 is forced to curve downwardly forming several convolutions for the formation of a coil. While the arrangement of the cooperative threading elements in FIG. 1 performs the preferred method of the invention, for illustrative purposes certain modifications have been made to the preferred form to aid in obtaining a quick overall view of the invention. In a normal practice, reduction of the diameter and/or wall thickness of tubing is done by pulling the tubing through a reduction die 16, and as is well-known, adequate tension for this drafting is supplied by wedging the tubing 14 into the groove 12 where the tubing contacts the block 10 over an arc less than 360°. This system for reducing tubing is disclosed in U.S. Pat. Nos. 3,881,340 issuing to Hay and 4,149,398 issuing to E. B. Eichenlaub, and may be similarly used for drafting wire. These patents also show the usual construction of the block and drive, for which reason a detailed description will not be given. In the FIGS. 1–7, like numerals indicate the same components.

In still referring to FIG. 1, there is schematically illustrated the positioning of the drawing equipment in an automatic "threading" or "stringing" up of tubing 14 on a block 10 preparatory to an initial stage of the drawing operation. Gripper mechanism 18 mounted to a disc or plate 20 is positioned immediately in back of a die box 16 containing a die assembly and straightening rolls (not shown). Plate 20 is freely rotatably mounted on a shaft 22 by bearings 54 and is concentric to rotatable block assembly 10, which is also carried and driven by shaft 22. In addition, shearing mechanism 42 and deflector assembly 24 are mounted on plate 20 to the left of gripper mechanism 18 in FIG. 1. Supported externally of block 10 is a pivotally mounted pressure roller assembly 26 for applying pressure against a single strand or length of tubing to aid in forcing the tubing 14 into the groove 12 in the threading stage, and to aid in retaining tubing 14 in the groove during the full stage drawing process. More than one roller assembly 26 may be positioned around the periphery of block 10, but only one is shown in this FIG. 1.

Gripper head 28 of gripper mechanism 18 grasps a pointed end section of the leading end of a coil of tubing, which pointed end is specially prepared for easy access into reduction die 16 for threading purposes, and as plate 20 is rotated counter-clockwise, with the block 10 by means of clutch assemblies 46 which are to be described later, tubing 14 is pulled through the die and caused to be placed in groove 12 upon an approximate rotation of 310° of both plate 20 and block 10.

Figure 2:
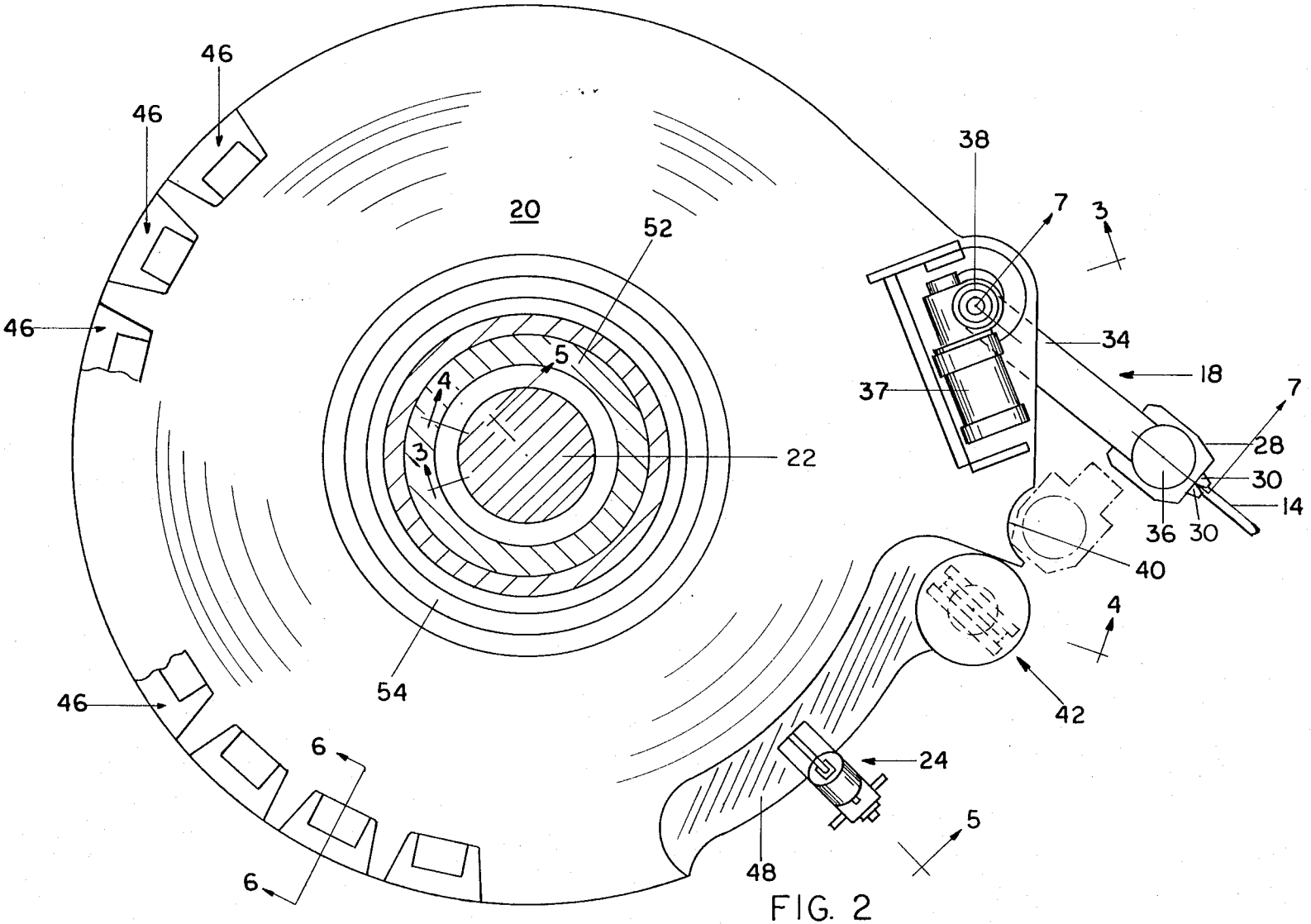
FIG. 2 is a plan view of a preferred form of the subject invention.

In FIG. 2, which illustrates the preferred form of the invention along with the remaining figures, plate 20 is positioned similarly as shown in FIG. 1 in that prior to the threading stage, gripper mechanism 18 is in line with die box 16 (only shown in FIG. 1), and tubing 14 is grasped between gripper jaws 30, more about which will be explained later. Gripper head 28 and gripper arm 34 are held rigid by their piston cylinder assemblies 36 and 37, respectively as shown in FIG. 2. Prior to the completion of the 310° rotation of block 10 with plate 20, in a counter-clockwise direction when particularly referring to FIG. 1, at approximately 280°, the shearing mechanism 42 is activated by means explained later to start the shearing step to sever the tubing 14 as plate 20 rotates, which step is completed with no relative speed difference between the tube and shear at approximately the same time or shortly before plate 20 reaches its complete rotation.

During this 310° rotation piston cylinder assemblies 36 and 37 are such that gripper head 28 and arm 34 are free to move so that tubing 14 is placed in groove 12 (FIG. 1). Since this is the case upon rotation of plate 20, both head 28 and arm 34 are caused to be pulled toward the center of block 10 and plate 20, as shown in phantom in FIG. 2, where a machined cut-out section 40 receives head 28. Only after gripper mechanism 18 has passed pressure roller assembly 26 (FIG. 1) will roller 44 be activated to move towards block 10 to hold tubing 14 in groove 12. Upon complete rotation of plate 20 to its 310° parked position, gripper head 28 and arm 34 are moved by piston cylinders 36, 37 respectively in a rigid position similar to that of the starting position shown in FIG. 1 away from block 10 to clear the drawn tubing leaving block 10. In the parked position of plate 20 and gripper mechanism 18, eventually gripper jaws 30 are automatically opened by control means (not shown) but familiar to the art to release the pointed end of tubing, which is appropriately discarded. During this period, the plate 20 remains stationary, but block 10 continues to rotate without interruption to the desired drawing speed, causing the remaining length of tubing to travel out of the way of gripper mechanism 18 below block assembly 10 in a spiralling fashion into a basket, not shown, but wellknown in tube drawing where coils are formed. It is to be appreciated that this procedure describes a batch process where coils of tubing are handled individually. More of the operation of the subject invention relative to the drawing process will be discussed later.

FIG. 2 shows in a scale smaller than FIGS. 3–7, the placement of gripper mechanism 18, shearing mechanism 42, deflector assembly 24, and clutch assemblies 46 relative to each other on plate 20. As mentioned previously, the positioning of plate 20 is such that gripper mechanism 18 is in line with reduction die 16. Plate 20 is generally circular being of a greater diameter than block 10 as clearly shown in FIGS. 3, 4, and 6. A machined portion 48 receives the mounting for shearing mechanism 42 and deflector assembly 24, and small radius machined cut-out 40 is located to the right of portion 48 for receiving gripper head 28 as shown in phantom and as explained previously. Stopping devices mounted on gripper arm 34 interrupt its movement so that it does not touch plate 20 or block 10 when moving toward these elements.

FIGS. 3–7 give greater details for the construction of the individual components of plate 20, including the mounting of plate 20 on main shaft 22 carrying block assembly 10, and the manner in which clutch assemblies 46 engage and disengage drawing block 10. Numerals 52 and 54 indicate bearings for drawing block 10 and plate 20, respectively, for their mounting on shaft 22.

Figure 3:
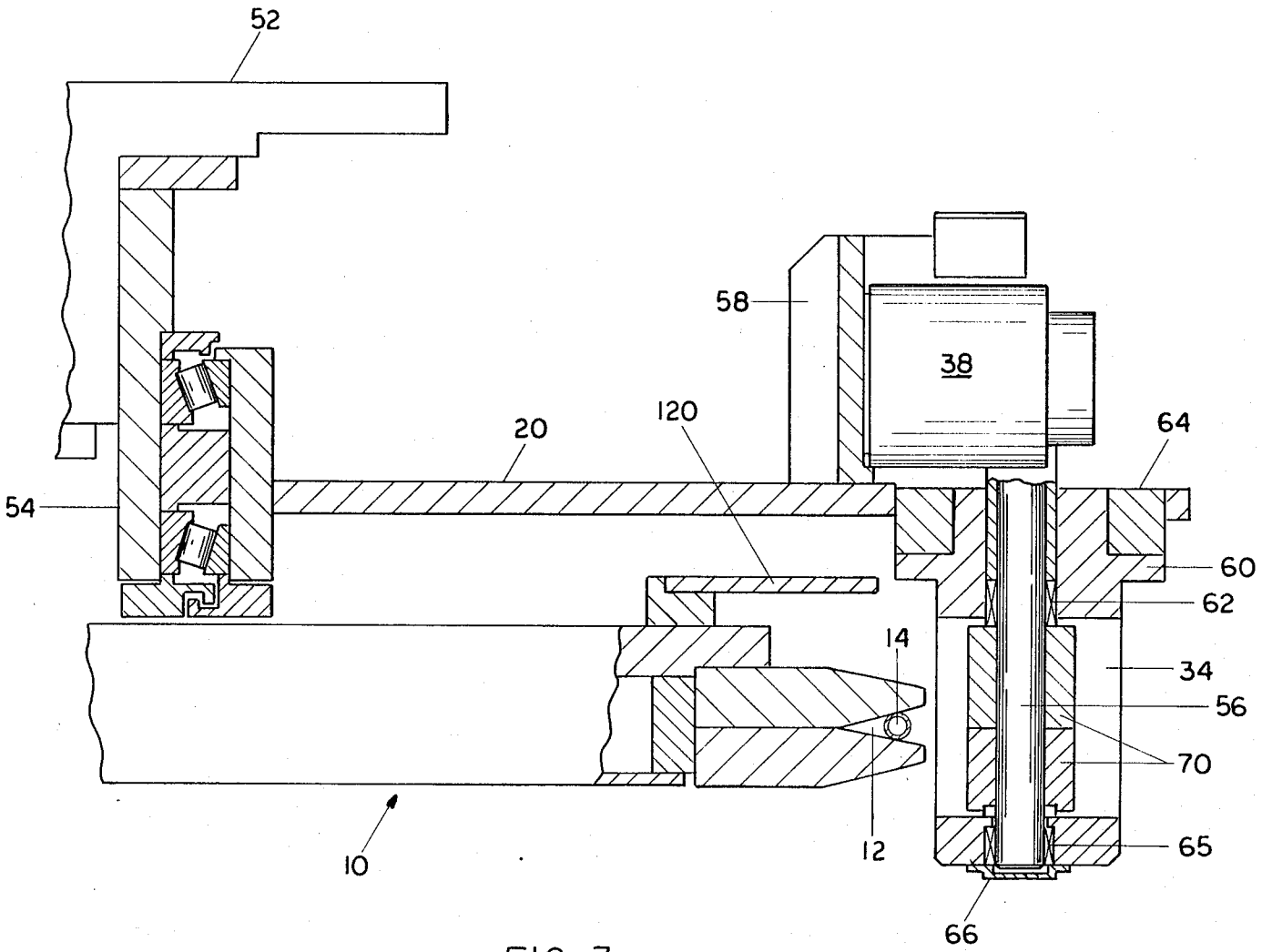
FIG. 3 is an elevational, partly broken away cross sectional view taken along lines 3—3 of FIG. 2.
Figure 7:
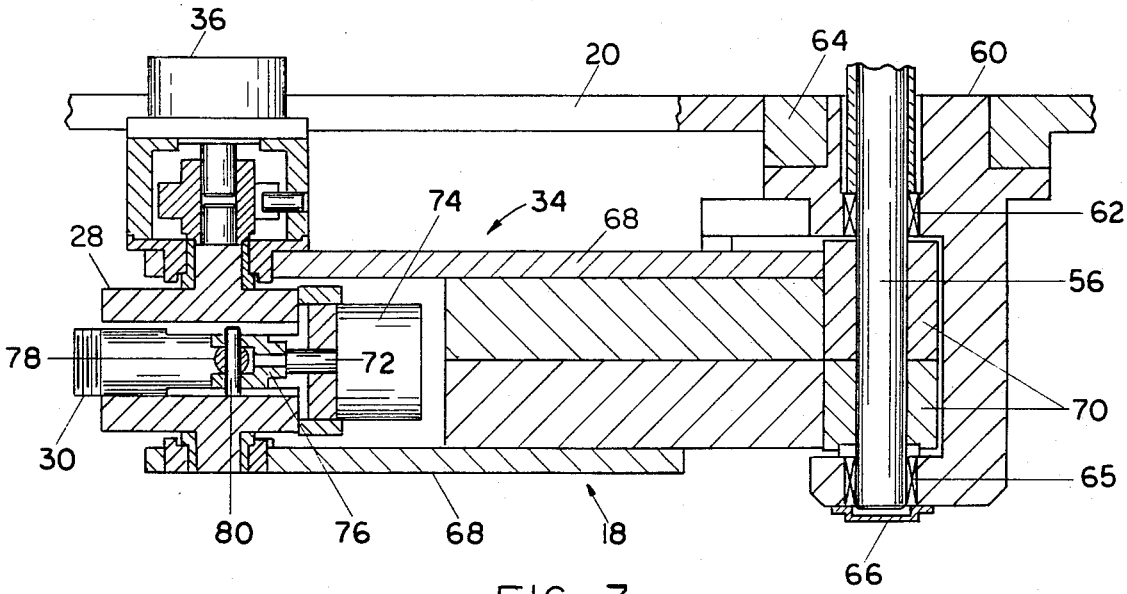
FIG. 7 is a cross-sectional view taken along lines 7—7 of FIG. 2.

As FIGS. 3 and 7 show, gripper mechanism 18 is mounted to plate 20 by shaft 56 which extends up into a housing of a rack and pinion arrangement 38 mounted on plate 20 by a mounting bracket 58. Member 60 is used to secure shaft 56 and its bearings 62 into a ring member 64 welded into plate 20. Cap 66 at the end of shaft 56 and mounted around bearings 65, retains lubricant. Linear movement of the rod of piston cylinder assembly 37 is translated into a rotational movement of shaft 56, and hence gripper arm 34 and head 28, through the rack and pinion arrangement 38 which is shown only in FIG. 2, whereas the mounting bracket 58 for this rack and pinion arrangement 38 is shown in FIG. 3.

With particular reference to FIG. 7, gripper arm 34 consists of members 70 keyed to shaft 56. The members 70 carry two plates 68 between which gripper head 28 is pivotally mounted. Gripper head 28 consists of two gripper jaws 30 of which one is only shown in FIG. 7. These gripper jaws 30 are in the form of two wedges which slide along corresponding tapering surfaces of header 28 between open and closed positions. This sliding movement is effected by a rod 72 of a piston cylinder assembly 74, which rod 72 has a clevis portion 76 connected to a pin 78 extending between and into gripper jaws 30, and through which, another pin 80 extends. The two jaws 30 are shown in FIG. 2. This design for gripper head 18 is well-known and available in the industry.

Pin 78 is designed such that upon an opening and closing of jaws 30 it moves linearly within members 30 thereby permitting their movement relative to each other. For the pivoting of gripper head 28, the rotary action piston cylinder assembly 36 is provided. This rotary action piston cylinder assembly 36 is mounted on gripper head 28 for its movement therewith, and is a staple commodity available in the industry. As alluded to already, this construction of gripper mechanism 18 is such that arm 34 and gripper head 28 can move together as a unit or relative to each other through the operation of piston cylinder assembly 37 and its associated rack and pinion assembly 38, or piston cylinder assembly 36 while gripper jaws 30 are moved linearly between open and closed positions through operation of piston cylinder assembly 74.

The positioning of gripper mechanism 18 relative to the block assembly 10 is clearly shown in FIG. 3, where the greater diameter of plate 20 is necessary in order to clear the gripper from the edge of the grooved block 10. Jaws 30 are not shown in this FIG. 3, but they are positioned such that tubing 14 is placed in groove 12 as gripper mechanism 18 along with plate 20 is rotated around the outer periphery of block assembly 10.

Figure 4:
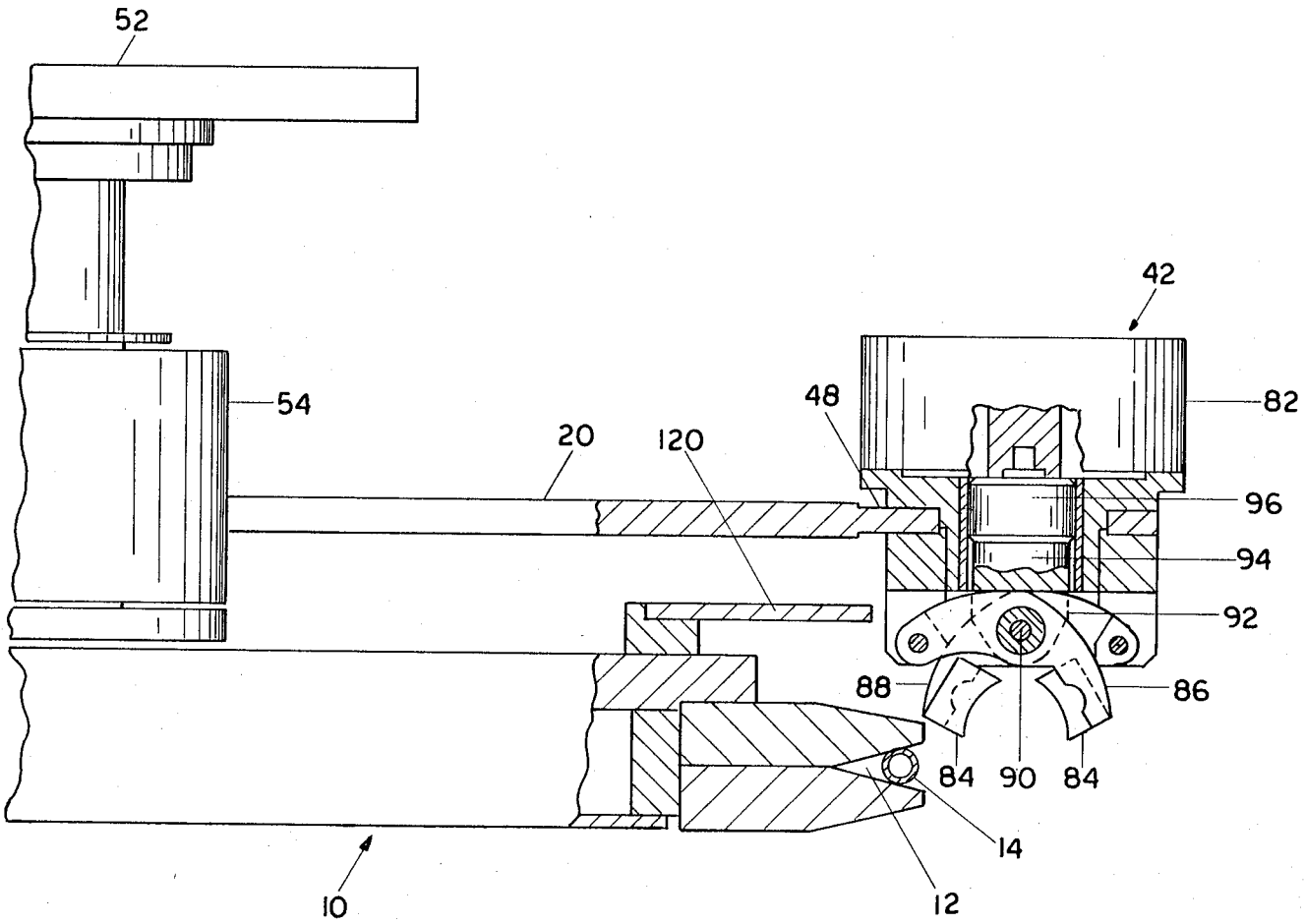
FIG. 4 is an elevational, partly broken away cross-sectional view taken along lines 4—4 of FIG. 2.

Referring to FIG. 4, shearing mechanism 42 is mounted along the circumference of and directly onto plate 20 by housing 82. Since shearing mechanism 42 is mounted to plate 20, and plate 20 is rotating at a specific time in the threading stage at the same speed as that of tubing 14, no relative motion exists between tubing 14 and blades 84, and therefore, shearing of tubing 14 can be easily effected without stopping rotation of plate 20, which normally had to be done in the prior designs where the shearing device was externally mounted remotely from the block assembly.

The shear blades 84 are carried on pivotal arms 86, 88 which are connected to each other and to a clevis 92 by means of a cross pin 90. The clevis is carried on the piston rod 94 of a cylinder 96 arranged in housing 82. Since housing 82 is stationarily mounted on disc 20, movement of piston rod 94 along with clevis 92 and pin 90 in a downwardly direction when referring to FIG. 4, causes the arms 86 and 88 to travel in an arcuate path in a direction where blades 84 are brought together down into the path of travel of tubing 14 to effect the shearing of the pointed end section. As is apparent in FIG. 4, where the arms 86 and 88 are in their inoperative positions, they and the blades 84 are clear of groove 12 and tubing 14. In view of this, there is less likelihood of cutting or marring the groove 12, which may result in marking or scratching of the tubing 14.

Figure 5:
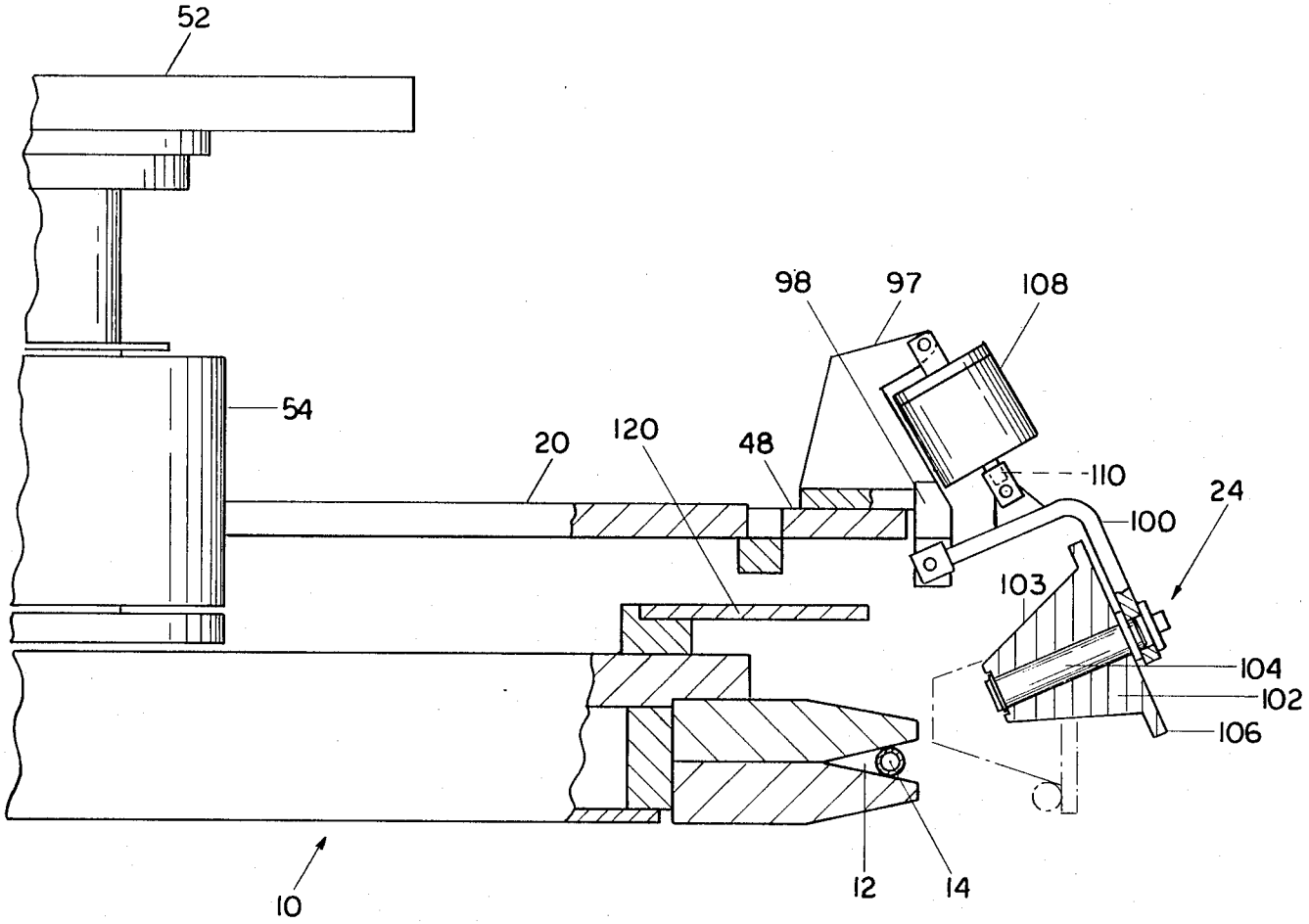
FIG. 5 is an elevational, partly broken away cross-sectional view taken along lines 5—5 of FIG. 2.

Deflector assembly 24 is clearly shown in FIG. 5. As mentioned earlier, machined portion 48 of plate 20 receives in addition to shearing mechanism 42, deflector assembly 24 which consists of a bracket 97 mounted by suitable means (not shown) on the edge of plate 20. Extending downwardly from bracket 97 is a leg 98 for pivotally mounting an "L" shaped member 100 which carries a roller 102 freely rotatably on a snub shaft 104. Roller 102 has a tapering circumferential surface 103 which ends in an inward flange portion 106.

A piston cylinder assembly 108 is mounted between bracket 98 and member 100. Linear travel of piston rod 110 causes member 100, and therefore, roller 102 to move in an arcuate path towards and away from the grooved block 10. Extending of rod 110 of piston cylinder assembly 108 moves roller 104 towards the groove 12 as shown in phantom in FIG. 5. This phantom positioning of deflector roll 102 causes tubing 14 to ride down along tapered surface 103 until it hits against flange 106, at which time tubing 14 is caused to fall downwardly into a coil in the collecting basket, mentioned above, and not shown. Roller 102 is brought into a phantom positioning cooperatively adjacent groove 12 approximately at the same time shearing mechanism 42 is activated to cut the pointed end, which, as stated earlier, is a counterclockwise rotation of a range of 280 to 310 degrees of plate 20 and block 10.

FIG. 2 shows in plan view a number of clutch assemblies 46 mounted in a semi-circular fashion around a portion of the outer circumference of plate 20 which is mounted concentric to main shaft 22 via bearing assembly 54.

Figure 6:
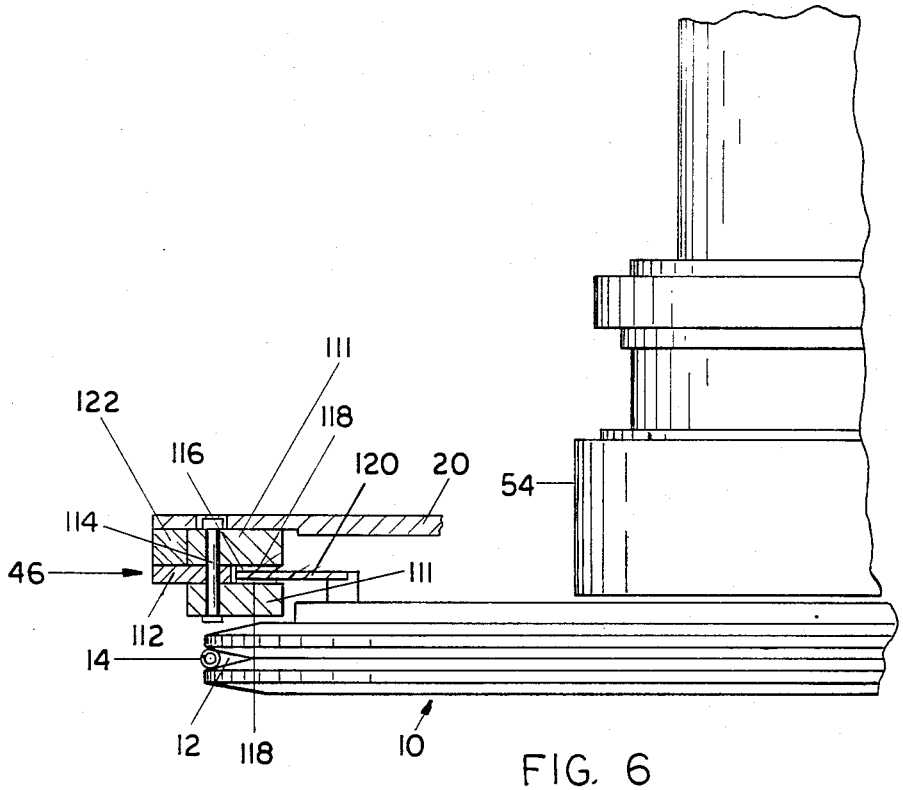
FIG. 6 is an elevational, partly broken away cross-sectional view taken along lines 6—6 of FIG. 2.

FIG. 6 shows in an elevational view, one such clutch assembly 46 and its mounting on plate 20, and the manner in which it is associated with drawing block 10. A portion of the block 10 and plate 20 on main shaft 22 is shown in FIG. 6, but it is to be understood that the other side is identical, except for clutch assemblies 46, which are located only semi-circularly on plate 20.

Each clutch assembly 46 is well-known in the industry as a single acting calipher disc brake which consists of two members 111 spaced apart from each other by member 112. The members 111 and 112 are interconnected by a bolt 114. In the gap 116 created by assemblage of members 112 and 111, are two opposed flexible discs or plates 118 mounted on opposed surfaces of the members 111, and as shown in FIG. 6, between these discs 118 is an extension member 120, which is bolted onto block assembly 10. Extension member 120 is a circular ring mounted around the entire perimeter of block assembly 10.

Member 112 is in the form of an arc and extends an arc length necessary to accommodate the severally arranged clutch assemblies 46. The mounting of these assemblies 46 is accomplished by providing another arcuate member 122 extending the arc length equal to that of member 112, but having a greater thickness than that of member 112. Bolts (not shown) at several locations mount member 122, and therefore, the clutch assemblies 46 to plate 20.

Engagement of plate 20 with block assembly 10 is done by causing discs 118 to frictionally engage the extension member 120 therebetween. If, at this time block assembly 10 is rotated, than it is obvious that plate 20 will be rotated at the same rate of speed as block assembly 10. Since a substantial amount of torque is required in order for the tubing 14 to be pulled through the reduction die 16 by gripper mechanism 18, a substantial amount of frictional force or resistance has to be generated in the threading stage so that a no-slip condition exists between flexible discs 118 and member 120, and therefore, in a preferred embodiment several clutch assemblies 46 are utilized. High pressure, hydraulic fluid is supplied through source lines (not shown) to force discs 118 to contact ring member 120. At the end of the batch drawing process, where plate 20 is to be returned to its initial position a minimum amount of torque is necessary to rotate the block assembly 10 since tubing 14 is no longer being pulled by gripper 18 nor is it in contact with block assembly 10. In this instance, low air pressure, through source line (not shown) is supplied to at least one of the clutch assemblies 46. Supplying of the hydraulic fluid or air causes flexible discs 118 to extend and naturally, if no pressure is supplied, then a clearance or gap 116 between disc pads 118 and member 120 exists, and there can be relative rotation between block 10 and plate 20.

These clutch assemblies 46 are standard commodity items available in the market. They are manufactured by Goodyear Tire Company, and are referred to as Aircraft Caliper Brakes. Flexible pads 118 could be made of a fibrous material capable of withstanding high temperatures, such as asbestos.

Still referring to FIG. 6, and also FIG. 1, rotation of block assembly 10 is done through a main motor drive 124 connected to main shaft 22. The single rotation of main shaft 22 for the threading stage is detected by a digital pulser 126 associated with main motor drive 124, which in turn, sends a signal to the control box 128 for the time sequential operation of gripper mechanism 18, shearing mechanism 42, deflector assembly 24, and clutch assemblies 46, which operation of these elements is shown schematically by the arrow coming out of control 128 in FIG. 1.

To reiterate some of the significant steps of operation of the subject invention in block assembly 10, in the threading stage gripper mechanism 18 grasps the end of tubing 14. At this time, shearing mechanism 42 and deflector assembly 24 are in their inoperative positions away from the groove 12 as shown in FIGS. 4 and 5. Hydraulic fluid is supplied to several of the clutch assemblies 46 so that plate 20 and ring member 120 are frictionally interlocked. Main shaft 22 along with block assembly 10 and plate 20 is rotated at a low speed to an approximate angle of 310°.

At approximately 280°, deflector roller 102 is pivoted toward groove 12 and blades 84 of shearing mechanism 42 are caused to be lowered and brought together for the shearing of the end of tubing. A complete shearing of tubing is accomplished at the same time or prior to the 310° rotation. After shearing, arms 86 and 88 with blades 84 are raised out of the path of travel of tubing 14 away from groove 12 in the position shown in FIG. 4.

The supply of pressure in clutch assemblies 46 is interrupted so that plate 20 disengages ring member 120, thereby stopping its rotation with block 10 while the block 10 continues its rotation which has not been interrupted throughout this threading phase. The motor current is increased to rotate block 10 at a desirable drawing speed for the drawing operation, and at the same time, deflector roller 102 starts to guide tubing 14 into the receiving basket located below and concentric to block assembly 10. In some drawing operations where drawing speed, tube size, or tube weight are major factors, this roller 102 can be swung out of the way of the block assembly 10 after it has attained its drawing speed. If left in its operative position where the tubing 14 contacts the tapered surface 103 of roller 102, complete control of tubing 14 into a helix configuration is accomplished.

During this drawing process operation, plate 20 is stationary through the use of a stop and shock absorber (not shown). The arm 34 and head 28 of gripper mechanism 18 are moved away from the groove 12 out of the way from the traveling tubing. At some instance, the jaws 30 of gripper mechanism 18 are opened to permit the pointed end of tubing to be released from between jaws 30, 30 and one or several pressure roller ass 26 have been brought into their operative positions to maintain the tubing 14 in the groove 12.

At the termination of the batch drawing process, air is supplied to at least one of the clutch assemblies 46, main motor 124 is reversed, and plate 20 with block assembly 10 is rotated 310° in a reverse direction. Here again, digital pulser 126 detects this movement so that rotation of plate 20 is interrupted at the appropriate rotational angle placing gripper head 28 in line to receive the tapered end of a new coil.

From the above, it is easy to appreciate that little or no operator supervision is required, and that the equipment including the components of the subject invention can be fully automated through control 128.

The subject invention requires many power lines for its operation, and it is to be noted that the handling of these lines is easily accomplished through the use of a hose carrier which is a staple commodity known as the Catrac TM, manufactured by Gemco Electric Company, Clawson, Michigan, which provides for the easy rotation of these lines with plate 20.

The preferred embodiment has been explained in the environment of a grooved block assembly for drawing copper tubing, however, it may also be used with modifications in conjunction with a spinner block arrangement, and also mounted on a shaft separate from the block assembly 10. Moreover, the various features of the invention as disclosed herein can be adapted for use in the automatic threading of other filament material, including non-metals and other than wire or tubing, and in conjunction with processes other than a drawing process. Also, operation of the invention has been stated in terms of first a 310° rotation in a counter-clockwise direction and then a reversal of this in referring to FIGS. 1 and 2, but it can be such that the threading stage requires a clockwise rotation.

In accordance with the provisions of the patent statutes, we have explained the principle and operation of our invention, and have illustrated and described what we consider to represent the best embodiment thereof.

We claim:

1. In a drawing arrangement for reducing elongated strand material, such as wire or tubing, comprising:

a die assembly through which said material is continuously drawn throughout a drawing process, a rotatable block assembly located downstream from said die assembly having a cylindrial surface around which a length of said material is substantially wrapped so that a desired drawing tension is created to pull said material through said die assembly, drive means for rotating said block assembly, rotatable plate means constructed and arranged to be in close proximity and co-axial to said rotatable block assembly, gripper means carried by said plate means constructed and arranged in a manner to selectively grasp a tapered end of said strand material immediately exiting said die assembly for threading phase of said drawing process and to release said tapered end after said threading phase, and a shearing device carried by said plate means constructed and arranged in a manner to cooperate with said gripper means in a time sequence relationship during said threading phase to sever said tapered end from said length of said material after said length is arranged around said rotatable block assembly prior to said releasing of said end by said gripper means;

power transmitting means on said plate means or said block assembly for selectively causing said plate means to be engageable and disengageable with said rotatable block assembly, and constructed and arranged in a manner that upon said engagement said plate means rotates with said block assembly as a unit in the same direction and said gripper means places said strand of material on said cylindrical surface of said block assembly, said power transmitting means including means for automatically effecting the disengagement of said plate means from said block assembly upon a predetermined rotation of said block assembly without interrupting said rotation of said block assembly.

2. In a drawing arrangement according to claim 1, wherein said gripper means and said shearing device are arranged relative to each other in a manner that a predetermined length of material from said tapered end inwardly along said length is severed.

3. In a drawing arrangement according to claim 1, further comprising:

deflector assembly carried by said plate means constructed and arranged to cooperate with said shearing device in a time sequence relationship so that after said tapered end is severed said drawn material paid off said block assembly during said drawing process is deflected in a manner to spiral downwardly to form a coil.

4. In a drawing arrangement according to claim 3 wherein said gripper means, said shearing device, and said deflector assembly are located on the same general circumference of said plate means.

5. In a drawing arrangement according to claim 3, wherein said deflector assembly consists of a roller having a surface along which said material travels, and includes means for selectively bringing said deflector assembly into an operative position along a path of travel of said material and an inoperative position away from said path.

6. In a drawing arrangement according to claim 5, wherein said selective means for said deflector assembly comprises:

first bracket means stationarily mounted to said plate means, second bracket means pivotally connected to said first bracket mean for mounting said roller, and piston cylinder assembly means connected to said two bracket means for effecting said pivoting of said second bracket means.

7. In a drawing arrangement according to claim 1, wherein said shearing device comprises:

a housing, a piston cylinder assembly having a cylinder and rod mounted in said housing, wherein said rod has a clevis at one end, and at least two cooperate members each for releaseably securing a blade at one end, said members coaxially and centrally mounted on said clevis and each stationarily mounted at another end to an opposed portion of said housing, and further constructed and arranged in a manner that when said rod is forced outwardly from said cylinder, said blades are forced together into a path of travel of said material for said severing thereof.

8. In an arrangement according to claim 1, wherein said block assembly consists of a generally circular member, and wherein said power transmitting means consists of at least one clutch assembly having two members for carrying flexible pad means between which said circular member is positioned and wherein, for said engaging of said plate means with said block assembly, pressure is supplied to cause said pad means to move towards each other and for said automatic disengaging thereof said supply of pressure is discontinued causing said pad means to move apart thereby creating a clearance between said pad means and said circular member.

9. In an arrangement according to claim 8, wherein a plurality of said clutch assemblies are arranged semicircularly around said plate means, and includes means for delivering said pressure to effect said rotation of said plate means with said block assembly.

10. In an arrangement according to claim 3, further comprising:

control means for effecting the steps of said threading phase in said time sequence relationship so that after a gripping of said tapered end, said block assembly with said plate means are rotated approximately 310° degrees in a direction of which at approximately 280 degrees in said direction, said shear is activated to sever said end before reaching said 310 degree rotation; said plate mean is disengaged from said block assembly which continues to advance to its maximum drawing rotation and said deflector assembly is brought into operation to contact said material being drawn.

11. In an arrangement according to claim 10, wherein said drive means includes:

a shaft for concentrically mounting said rotatable block assembly and said rotatable plate means, and means associated with said shaft for detecting said angle of said rotation of said block assembly with said plate means and for transmitting a signal representative thereof to said control means.

12. In an arrangement according to claim 1, wherein said gripper means consists of:

an arm, a head pivotally mounted on said arm and having inclined surfaces and movable wedge members for said gripping and releasing of said tapered end when said wedges are moved along said inclined surfaces.

first piston cylinder assembly means associated with said arm and said plate means, including means for moving said gripper means towards and away from a path of travel of said material, and second piston cylinder assembly means for effecting said movement of said wedge members, and third piston cylinder assembly means for effecting rotational movement of said head towards and away from said plate means.

13. In an arrangement according to claim 1, wherein said block assembly and said plate means are generally circular and the diametric dimension of said plate means is greater than that of said block assembly.

14. In an arrangement for automatically placing a length of filament material around a generally cylindrical surface of a rotatable member so that said material can be advanced to said rotatable member from a position upstream thereof, comprising:

drive means for rotating said rotatable member, rotatable plate means constructed and arranged in a manner to be in close proximity and co-axial to said rotatable member, gripper means carried by said plate means constructed and arranged in a manner to selectively grasp and release a leading end of said material positioned for gripping by said gripper means, the relationship of said rotatable member, said plate means, and said gripper means being such that said gripper means on moving from a start position will place said material on said cylindrical surface, and shearing means carried by said plate means constructed and arranged to selectively engage and sever said material behind the place grasped by said gripping means in a time sequence relationship so that said leading end of said material is removed prior to a complete rotation of said plate means with said rotatable member power transmitting means mounted to either said plate means or said rotatable member for selectively causing said plate means to be in engagement or disengagement with respect to said rotatable member, and constructed in a manner that upon said engagement said plate means rotates with said rotatable member in the same direction, said power transmitting means including means for automatically effecting said disengagement of said plate means from said rotatable member upon a predetermined rotation of said rotatable member without interrupting said rotation of said rotatable member.

15. In an arrangement according to claim 14, further comprising:

deflector means carried by said plate means constructed and arranged to selectively contact said main body portion of said material at least immediately after said shearing means is effected in a manner said main body portion is guided away from said rotatable member as it is being paid off said rotatable member.

16. In an arrangement according to claim 14, wherein said power transmitting means consists of caliper disc brakes mounted on said plate means, and wherein said rotatable member consists of an annular member which is positioned between braking surfaces of said disc brakes so that upon said engagement of said plate means with said rotatable member said braking surfaces contact said annular member.

17. In an arrangement according to claim 14, wherein said plate means and said rotatable member are mounted on the same shaft.

18. In a method for automatically handling filament-like material during a threading procedure in which the material is to be placed at least partially around the periphery of a rotatable member, such as a wire drawing block, and wherein a carrying means is arranged to rotate concentrically with and in the same direction of the block and carrying a gripping means and a shearing means, the shearing means being adapted to selectively engage the material behind the place gripped by said gripping means when the gripping means is in its phase to release the material, the steps comprising:

with said gripper means in a start phase, causing the gripper means to grip the leading end of the material, at approximately the same time as said gripping step, initiating the rotation of said block and at approximately the same time connecting in a driving relationship said carrying means to said block to cause said carrying means to displace said gripper means and cause the material to be at least partially tightly wound around the block, causing said shearing means to sever the material with little or no relative movement between the moving shearing means and material either immediately before or during the time said carrying means assumes its release and stop phase, whereby a portion of the leading end of the material is removed from the main body portion while the block continues to rotate before said block and carrier means have rotated a predetermined amount, bringing the gripper means to a release and stop phase and degripping the material and at approximately the same time causing a deceleration of the carrying means while continuing to rotate said block.

19. In a method according to claim 18 wherein a deflector assembly is also carried by said carrying means and adapted to selectively engage the material behind the place severed by said shearing means, the additional step of:

causing said deflector assembly to assume an operative position to contact and deflect said main body portion of said material at least immediately after said shearing step while said block continues to rotate so as to guide said main body portion continually being paid off of said block.

20. In a method according to claim 19 wherein said shearing and deflecting steps are effected before at least the last third of one complete revolution of said carrying means by said block.

21. Apparatus for drawing elongated strand material, such as for example wire of tubing, through a reduction die, said apparatus comprising:

a drawing block rotatable about an axis and around which said strand material is wrapped to develop the tension required to pull said strand material through said die;

means for rotatably driving said drawing block;

a carrier element adjacent said drawing block and freely rotatable about said axis;

gripper means on said carrier element for releasably holding an end of said strand material following the insertion of said end through said reduction die;

power transmitting means for releasably connecting said carrier element to said drawing block to thereby cause said carrier element to rotate in unison with said drawing block in order to develop said tension by wrapping said strand material around said drawing block; and shear means on said carrier element for severing said end from said strand material following the development of said tension, whereupon said end may be released by said gripper means and discarded while said material continues to be pulled through said die.

* * * * *